US008276598B1

(12) United States Patent
Shepard et al.

(10) Patent No.: US 8,276,598 B1
(45) Date of Patent: Oct. 2, 2012

(54) MULTIPURPOSE HAIR CLIP

(76) Inventors: Lisa Palmer Shepard, Lakewood Ranch, FL (US); John Shepard, Lakewood Ranch, FL (US)

( * ) Notice: Subject to any disclaimer, the term of this patent is extended or adjusted under 35 U.S.C. 154(b) by 119 days.

(21) Appl. No.: 12/859,641

(22) Filed: Aug. 19, 2010

(51) Int. Cl.
*A45D 8/20* (2006.01)
*A44B 6/00* (2006.01)

(52) U.S. Cl. ..... 132/275; 24/3.7; 24/3.11; 132/277

(58) Field of Classification Search ..... 132/273, 132/277, 275, 276, 278, 279, 286, 132, 133, 132/134, 138, 151, 156; 24/3.7, 3.9, 3.11, 24/339, 511, 510, 556, 546; D28/39, 40, D28/41, 42
See application file for complete search history.

(56) References Cited

U.S. PATENT DOCUMENTS

| | | | | |
|---|---|---|---|---|
| D152,216 | S | 12/1948 | Quethera | |
| 2,601,858 | A | 9/1950 | Ackerman | |
| D161,071 | S | 11/1950 | Weiss | |
| 3,465,760 | A | 9/1969 | Sobel | |
| 5,533,533 | A | 7/1996 | Shing | |
| 5,549,127 | A | 8/1996 | Chang | |
| D378,817 | S | 4/1997 | Dijkstra | |
| 5,735,296 | A * | 4/1998 | Chen | 132/277 |
| 5,842,482 | A | 12/1998 | Potut | |
| 5,862,815 | A | 1/1999 | Murphy et al. | |
| 5,873,377 | A | 2/1999 | Yang | |
| 6,189,542 | B1 * | 2/2001 | Shepard | 132/273 |

* cited by examiner

*Primary Examiner* — Todd Manahan
*Assistant Examiner* — Niyati D Shah
(74) *Attorney, Agent, or Firm* — McHale & Slavin, P.A.

(57) ABSTRACT

An improved hair clip employs a pair of cooperating main members that are pivotally connected and biased into a hair engaging orientation. Each of the main members is contoured and includes a first end spaced apart from a second end by a middle portion. The first end of each main member acts as an articulation tab that allows an individual to apply leverage necessary to place the clip in a hair engaging orientation. Attachment sleeves are removably attached to the main member middle portions with a centrally located articulation storage sleeve. Each storage sleeve may be capped for storage of loose items or may accept one of several interchangeable accessory tubes. A depending cover member is provided for positioning of a mirror for use in cosmetics application.

17 Claims, 10 Drawing Sheets

MULTIPURPOSE HAIR CLIP

FIELD OF THE INVENTION

This invention is directed to hair accessories and, in particular, to a hair clip having storage capabilities. This invention is related to and an improvement upon U.S. Pat. No. 6,189,542, the contents of which is incorporated herein by reference.

BACKGROUND OF THE INVENTION

Hair accessories of many types have been developed to help women maintain a variety of hairstyles. Some hair accessories, like bobby pins, are almost purely functional. Other such accessories, including ornate combs and barrettes, can be as decorative as they are functional.

Still other hair accessories are designed accomplish a single task in operation. Elastic bands enclosed in fabric, so-called "scrunchies," are one simple device often used for holding hair in a ponytail-type arrangement. Another relatively-simple hair accessory is known simply as a "hair clip." Hair clips typically involve spring biased elements that cooperatively hold hair in a desired position. This type of device is disclosed in U.S. Pat. Nos. 5,873,377 and 5,862,815.

Some hair accessories have been designed not only to hold hair, but to perform secondary functions, as well. For example, U.S. Pat. No. 5,533,533 discloses a foldable hair clip that includes a comb to allow hairstyle retouching during use. U.S. Des. Pat. No. 378,817 discloses a hair clip adapted to hold a scarf in a decorative manner.

While each of the known hair accessories may address a particular set of needs, there is still room for improvement. For example, many individuals who wear hair accessories are active women who wish to keep their hair tidy while engaged in various activities. A hair accessory that would not only keep hair in place, but that would also provide a way of carrying cosmetics or other relatively-small items would prove beneficial. Such a device would be especially useful for women engaged in sports, workouts, attending social, sporting events, or other times when carrying a purse might prove cumbersome such as a trip to the beach. The known hair accessories do not address this need, nor do they provide this type of enhanced functionality. This type of device would represent a step forward in this field and would allow an individual to carry a variety of items, while largely eliminating the need to carry such items in a purse.

Applicant's previous U.S. Pat. No. 6,189,542 addressed many of the aforementioned needs but it has been found that a sleeve can be positioned along an upper side surface and the use of concealment covers and enhance the ornamental shape and be used to house reflective mirrors. The hair accessory continues to keep hair tidy while providing a way of carrying cosmetics or other relatively-small items. The accessory provides enhanced storage capacity in a manner that is attractive and in a format that is easy to use.

SUMMARY OF THE INVENTION

The instant invention is an improved multipurpose hair clip accessory capable of storing cosmetics and other small items, while keeping hair in a preset position and largely eliminating the need to carry a purse. The hair clip includes a pair of pivotally-connected main members that are spring biased to cooperatively adopt a hair-holding orientation. The pivot is formed from an articulation sleeve that is receptive to a cosmetic related item. Each of the main members is essentially "S" shaped and includes a first end spaced apart from a second end by a middle portion. The first end of each main member includes an articulation tab that facilitates selective movement of the main members from a hair engaging orientation to a hair releasing orientation. Removably attached storage sleeves accommodate a variety of interchangeable accessory tubes. The storage sleeves may also be used without accessory tubes and may be capped to hold loose items. A cosmetics case and a mirror can be removably secured to the main member first ends. Alternatively, a contoured cover member can be attached beneath each main member for concealing of storage sleeves as well as to position a reflective mirror for use in applying of the cosmetics.

It is an objective of the instant invention to provide an improved multipurpose hair accessory that keeps hair tidy while providing a way of carrying cosmetics such as lipstick, lip gloss, chap stick, lip liner, perfume, mascara, sun screen, nail polish, mouth spray (BINACA), mouthwash, or other relatively-small items such as paper money, make-up brushes, hair pins, safety pins, writing pens, and the like.

An additional objective of the instant invention is to provide a hair accessory that relies upon an enlarged articulation point for placement of a cosmetic item.

Yet another objective of the instant invention is to provide a hair accessory that is modular in design to accommodate several interchangeable components as desired. The handles may include detachable mirrors wherein the mirrors may couple together to form an enlarged viewing surface. Alternatively the placement of mirrors can be performed within the inner surface of the contoured members.

Still a further objective of the instant invention is to provide a hair accessory that provides enhanced storage capacity in a manner that is attractive and in a format that is easy to use.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
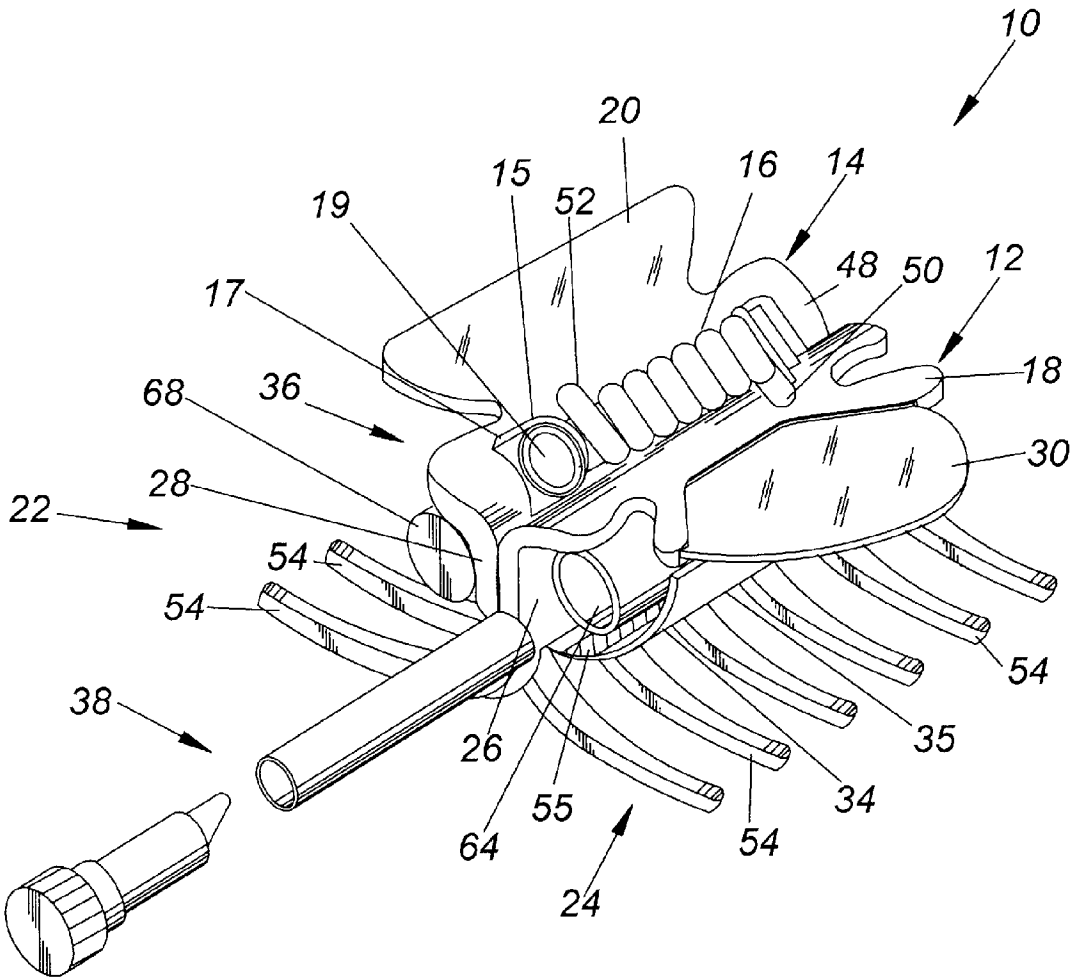
FIG. 1 is a perspective view of the hair clip of the present invention illustrating the articulation sleeve and a lipstick accessory tube removed.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIG. 1, the hair clip 10 of the present invention is shown. By way of overview, the hair clip 10 of the present invention includes a pair of pivotally-connected main members 12, 14, one of which includes an articulation sleeve member 15 that is biased by a spring assembly 16 into a hair engaging orientation.

The articulation sleeve member includes a first end opening 17 forming a chamber 19 for receipt of a cosmetic item such as an eyeliner brush. Each of the main members is contoured and includes a first end 18, 20 spaced apart from a second end 22, 24 by a middle portion 26, 28. As will be described more fully below, the first main member first end 18 may include a mounting location for a mirror 30, and the second main member first end 20 may include a mounting location for a cosmetics case 32, such as a foldable compact. The middle portion 26, 28 of each main member 12, 14 provides a mounting location for a corresponding storage sleeve 34, 36, also described more fully below. Interchangeable accessory tubes 38,40,42,44, seen with additional reference to FIGS. 3A, 3B, and 3C, may be selectively secured within the storage sleeves 36, 36, as desired. A sleeve cover 35 can be placed over the storage sleeve providing both an ornamental improvement to the hair clip but further providing an area for holding of a mirror that can be used in applying of a cosmetic. The hair clip 10 of the present invention also includes an alarm assembly that will indicate unwanted attempts to remove the device. The invention will now be described in detail.

As seen with combined reference to FIGS. 1, 2A, 2B, and 2C, each main member 12, 14 of the present invention 10 has an essentially S-shaped cross section. As mentioned above, each main member 12, 14 is characterized by first end 18, 20 spaced apart by a second end 22, 24 by a middle portion 26, 28. The main members 12, 14 are pivotally connected via a hinge construction 48 that extends between the main member middle portions 26, 28. The hinge construction is formed from an articulation sleeve member 15 that has a first end opening 17 and a closed second end forming a chamber 19 for receipt of a cosmetic item such as an eyeliner brush. The articulation sleeve member 15 can be molded into the upper surface of main member 14 with attachment tabs 21 molded into the upper surface of main member 12 allowing each of construction. It should be noted that the spring placement 16 is for illustration purposes and the actual spring may be concealed within the chamber 19 or a cover may be employed, not shown, that would allow an ornamental shape without viewing of the biasing spring 16. The spring assembly 16 associated with the hinge construction 48 includes leverage fingers 50,52 that engage the main member first ends 18,20 to urge the main members 12,14 into a hair engaging orientation. The second end 22,24 of each main member 12,14 includes a row of teeth 54 which cooperate to releasably engage a selected portion of an individual's hair, not shown, thereby keeping the hair tidy and the clip 10 removably secured in place. The clip 10 may be removed by squeezing the main member first ends 18, 20 towards one-another to temporarily overcome the spring constant of the spring assembly 16, thereby forcing the second ends 22, 24 apart and placing the clip 10 in a hair releasing orientation.

The first ends 18,20 not only serve as articulation tabs that aid in opening and closing the present clip 10, the first ends also serve as mounting locations for an optional mirror 30 and a cosmetics case 32, respectively. More particularly, and with additional reference to FIG. 4, the first end 18 of the first main member 12 includes a contoured channel 56 sized and shaped to engage the leading edge 58 of a mirror removably inserted therein. The first end 20 of the second main member 14 includes a pair of post apertures 60 sized and shaped to releasably engage corresponding case mounting posts 62 that extend from the exterior of the included cosmetics case 32, thereby securing the case 32 to the second main member 14. It is noted that the relative position of the posts 62 and apertures 60 may be reversed without adverse affect.

Figure 2A:
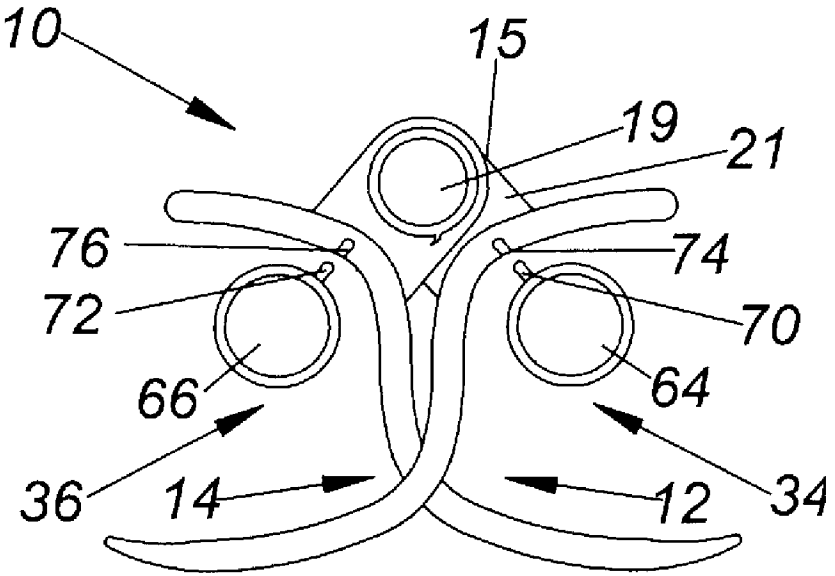
FIG. 2A is an end elevation of the hair clip of FIG. 1, showing storage sleeves attached with a post-and-aperture arrangement.
Figure 3C:
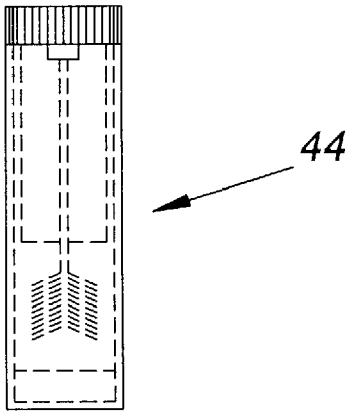
FIG. 3C is an elevation view of a mascara accessory tube used in the present invention.
Figure 3B:
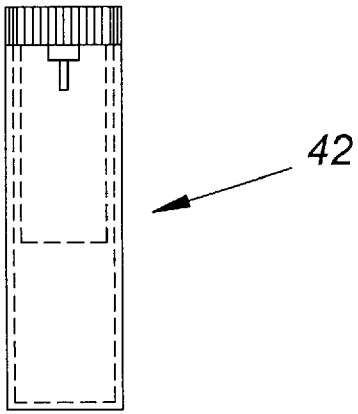
FIG. 3B is an elevation view of a perfume accessory tube used in the present invention.
Figure 3A:
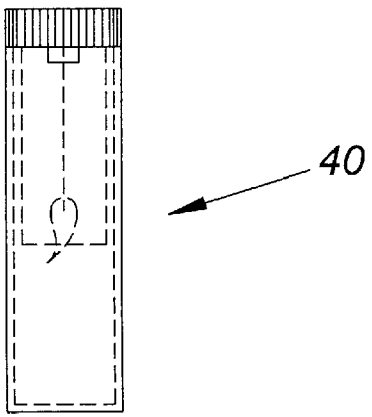
FIG. 3A is an elevation view of a nail polish accessory tube used in the present invention.
Figure 4:
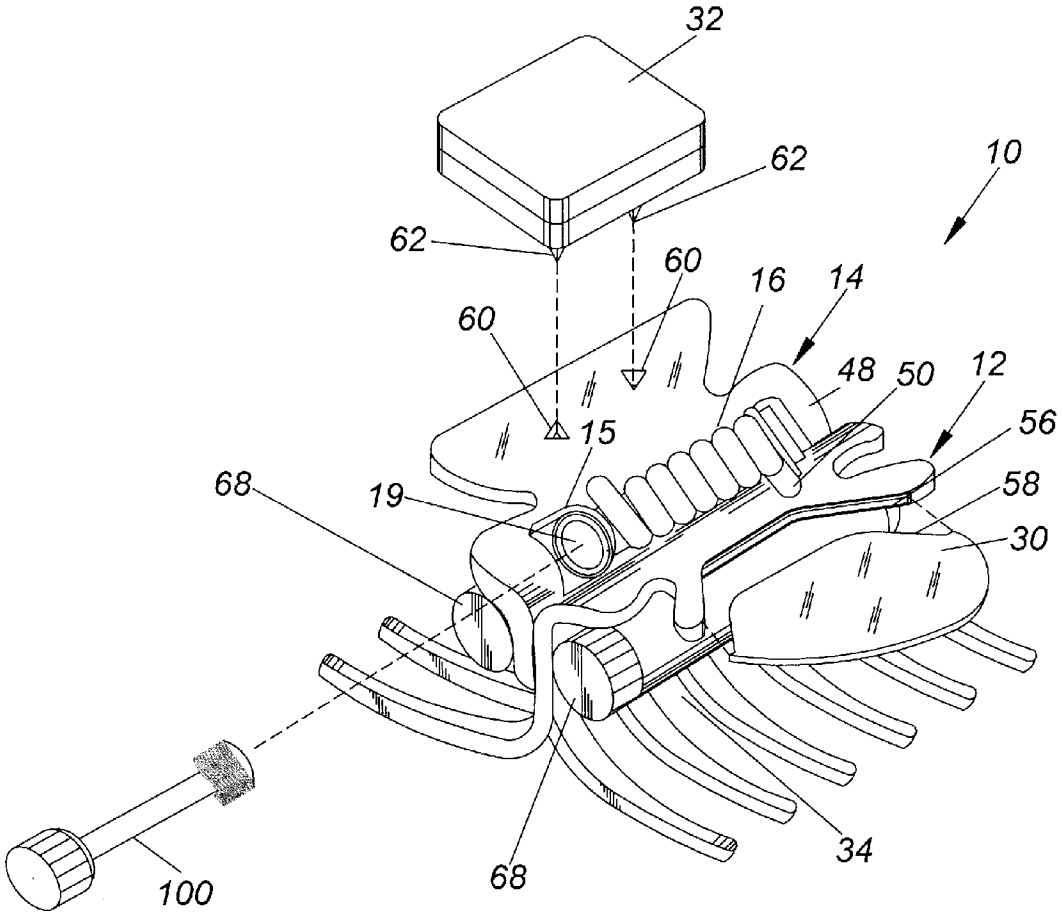
FIG. 4 is a perspective view of the hair clip shown in FIG. 1 illustrating a folding cosmetics case, a removable mirror; and a eyeliner brush accessory removed from the articulation sleeve member.

With continued reference to FIGS. 1 and 4, the articulation sleeve member 15 is sized to receive a cosmetic item such as a eyeliner applicator 100 providing utility to the device should the additional storage sleeves not be employed. The storage sleeves 34, 36 will now be described. Each storage sleeve 34, 36 resembles a hollow tube having a circular cross section. Each sleeve has an open end 64, 66, shown in FIGS. 2A, 2B and 2C, that allows an accessory tube 38,40,42,44 to be placed therein. The accessory tubes 38,40,42,44 are interchangeable and each tube includes a different type of product. FIG. 1 shows a lipstick accessory tube 38; FIG. 3A shows a nail polish accessory tube 40; FIG. 3B shows a perfume accessory tube 42; and FIG. 3C shows a mascara accessory tube 44. It is noted that the accessory tubes may contain other items as desired such as lipstick, lip gloss, chap stick, lip liner, sun screen, mouth spray (BINACA), mouthwash, or other relatively-small items such as paper money, make-up brushes, hair pins, safety pins, writing pens, and the like.

In keeping with the objectives of the present invention, the storage sleeves 34, 36 need not be used with accessory tubes, at all. The storage sleeves 34, 36 may be used to store loose items, such as change or rolled-up bills, not shown. For use without an accessory tube, the storage sleeves 34,36 may simply be closed via a removable end cap 68 sized and shaped to selectively seal the sleeve open ends 64,66, as shown in FIG. 4.

It is also noted that while the storage sleeves 34, 36 may be made from a variety of materials, a preferred material is plastic. If the storage sleeves 34, 36 are translucent or transparent, a chemiluminescent light source, not shown, may be placed therein to provide a decorative glow of light. In particular, the articulation sleeve member 15 provides distinctive light positioning.

Although the storage sleeves 34, 36 may be permanently attached to the main members 12, 14, the storage sleeves are preferably detachable. To this end, several methods of releasable attachment arrangements may be used, as exemplified in FIGS. 2A, 2B, and 2C. Referring to FIG. 2A, the storage sleeves 34,36 may be attached to corresponding main member middle portions 26,28 via a post-and-aperture arrangement More specifically, sleeve mounting posts 70,72 extend orthogonally from each sleeve 34,36 and each main member first end 18,20 includes mounting post apertures 74,76 disposed therein. Each of the sleeve mounting posts 70, 72 is sized and positioned to frictionally engage a corresponding mounting post aperture 74, 76. With this arrangement, the storage sleeves 34, 36 may each be releasably attached to a corresponding main member 12, 14. The number of posts 70, 72 and apertures 74, 76 is dependent upon the length of the sleeves 34, 36. In a preferred embodiment, each sleeve 34, 36 employs two posts 70, 72. It is also noted that the relative position of the posts 70, 72 and apertures 74, 76 may be reversed if desired.

Figure 2B:
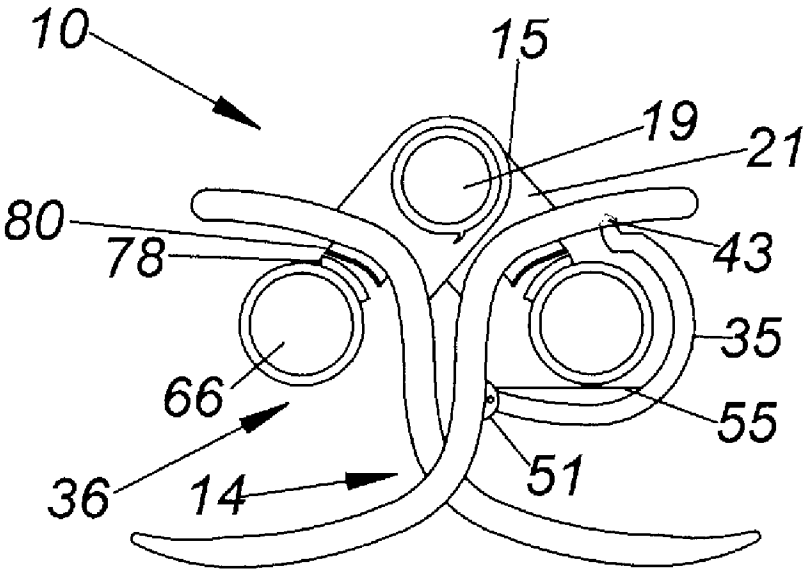
FIG. 2B is an end elevation of the hair clip of FIG. 1, showing storage sleeves attached with hook-and-loop fastening material and a depending cover member cover.

Now with respect to FIG. 2B, the storage sleeves 34,36 are shown to be releasably attached to corresponding main member 12,14 via hook-and-loop type fastening material 78,80, such as that available under the trademark VELCRO. More particularly, first portions 78 of hook-and-loop fastening material are disposed on the storage sleeves 34, 36, and corresponding second portions 80 of hook-and-loop fastening material are disposed on the main member middle portions 26, 28. With this arrangement, the storage sleeves 34, 36 may be releasably attached to the main members 12, 14 by pressing the corresponding portions 78, 80 of fastening material together.

Figure 2C:
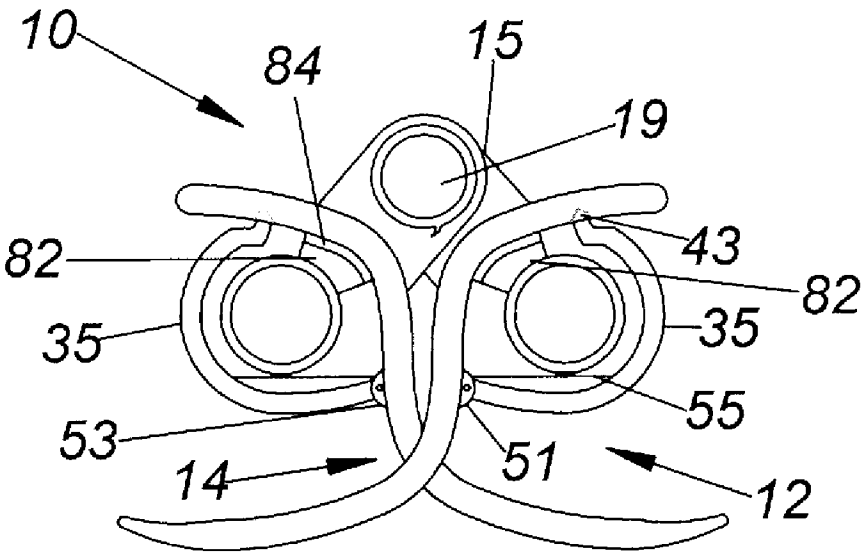
FIG. 2C is an end elevation of the hair clip of FIG. 1, showing the storage sleeves attached with a magnetic attachment arrangement with depending member covers.

With respect to FIG. 2C, the storage sleeves 34, 36 may be releasably attached to the main members via a magnet-and-plate arrangement. In this embodiment, magnets 82 are affixed to the storage sleeves 34, 36 and corresponding magnet-attractive plates 84 are affixed to the main member middle portions 26, 28. With this arrangement the storage sleeves 34, 36 may be releasably attached to the main members 12, 14 by placing the magnets 82 against the magnet-attractive plates 84. It is noted that the position of the plates 84 and magnets 82 may be reversed if desired. The plates 84' may alternatively be formed from resiliently-deformable plastic and shaped with a C-shaped cross section. In this manner, the plates 84' will act as clips to hold a variety of cylindrical items placed therein, including the sleeves 34, 36, as shown in FIG. 5.

Figure 5:
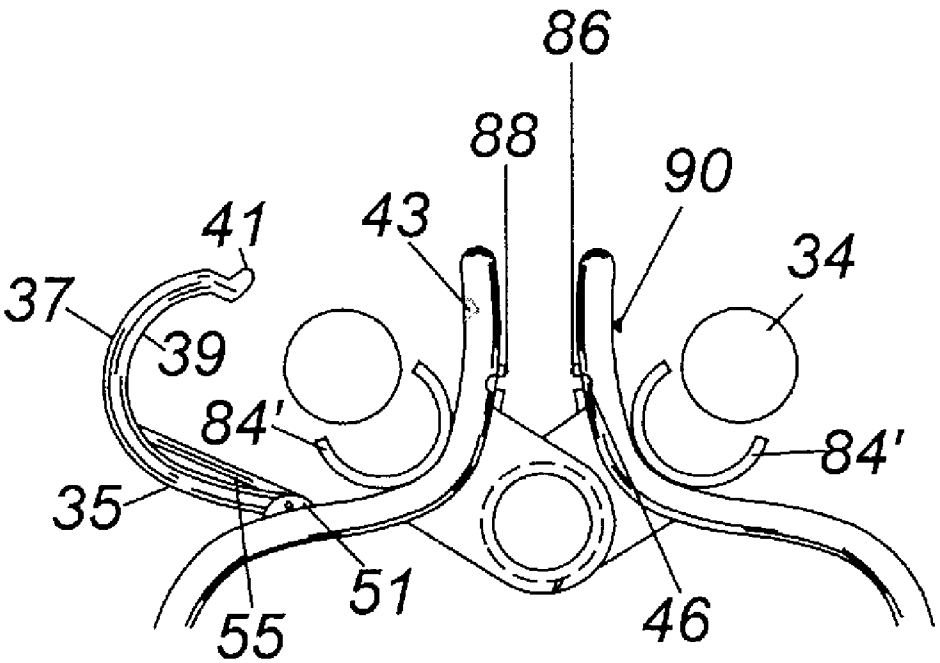
FIG. 5 is an end elevation view of an alternate embodiment of the sleeve attachment arrangement and a depending cover member in an open position.
Figure 6B:
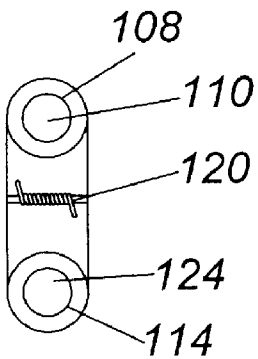
FIG. 6B is an end view of FIG. 6A.
Figure 6A:
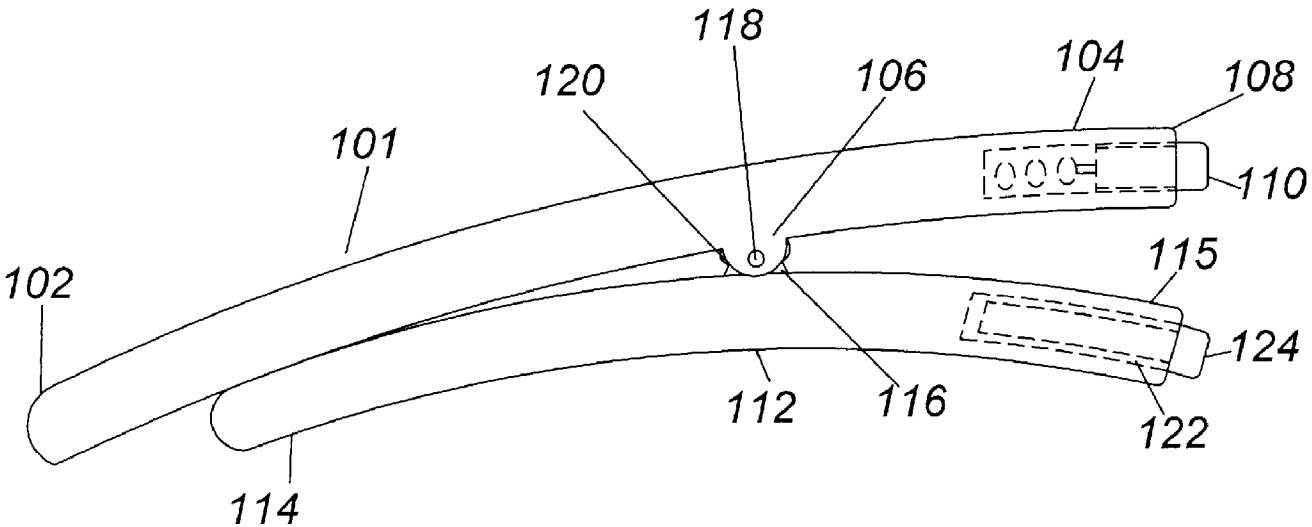
FIG. 6A is a side elevation view depicting a two prong hair clip with a compartment within each member.
Figure 6C:
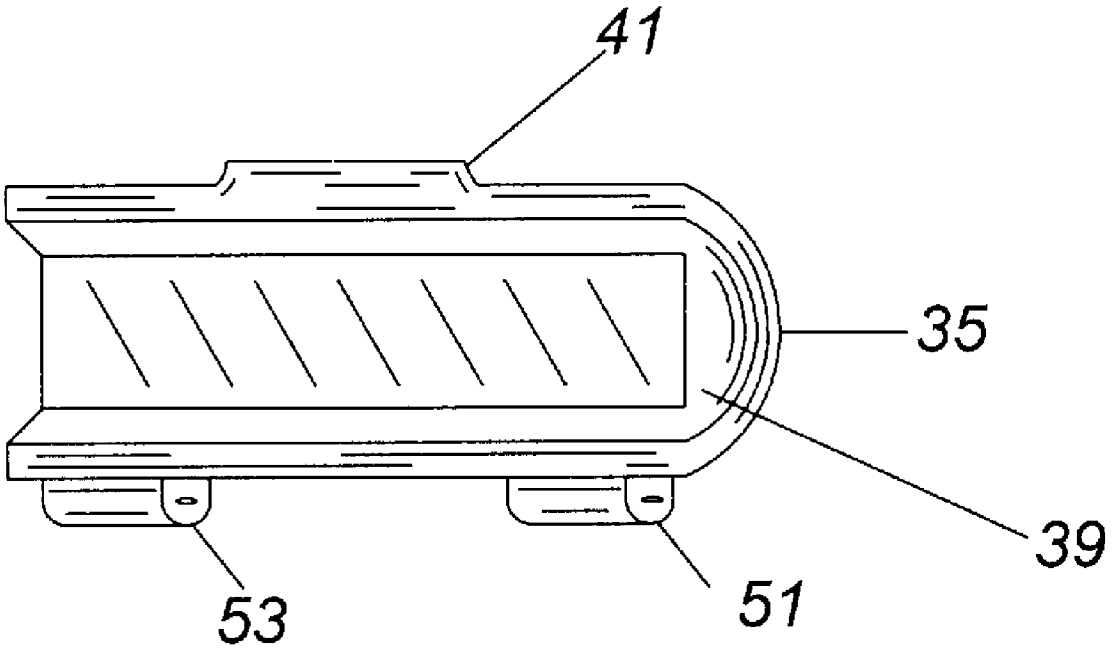
FIG. 6C is a side elevation view depicting the depending cover member detached from the apparatus.

Referring now to FIGS. 5 and 6C, the contoured depending cover member 35 is further defined by an outer surface 37 and an inner surface 39 with an insertion end 41 available to engage receptacle 43 for maintaining the cover in a closed position. While in the closed position, the cover provides an ornamental shape to enhance the hairclip as well as conceal the storage member positioned beneath the main member. To place the cover in an open position, it is rotated along hinge points 51 and 53 (FIG. 6C) wherein the inner surface 39 may house a reflective member, namely a mirror 55. The mirror can be a flat surface to provide an exact reflection or it can be convex or concave to either enlarge or reduce the viewing reflection. When two covers are employed, a flat mirror may be used on one side a separate viewing mirror on the other side allowing the user with a choice of reflective image size.

In keeping with the objectives of the present invention, the present hair clip 10 includes an alarm assembly 46 that indicates unwanted attempts to remove the device. In a preferred embodiment, the alarm assembly 46 includes a pair of electrical contacts 86, 88 that, when brought together, cause an included battery-operated speaker 90 to emit an audible tone. As seen in FIG. 5, the contacts 86,88 are positioned to touch as the main member first ends 18,20 are brought together to release the clip 10.

Referring now to FIGS. 6A and 6B, set forth is another embodiment of the invention comprising a contoured first member 100 having a first end 102 spaced apart from a second end 104 by a middle portion 106. The second end 104 includes a storage sleeve 108 for receipt of a cosmetic item 110. A contoured second member 112 has a first end 114 spaced apart from a second end 115 by a middle portion 116. The middle portion 116 of the second member 112 is pivotally attached to the middle portion 106 of the first member 100 by a pin axle 118. It should be noted that the hair clip is shown in its biased condition with the first ends 102 and 114 in a normally closed position.

A spring 120 is attached to the pin axle 118 and the middle portions 106 and 116 in a similar manner to the above mentioned springs for urging the first end 102 of said first member 100 and the first end 114 of the second member 112 into a hair-securing orientation. In a first embodiment, the storage sleeve 108 is formed by placement of an aperture within the second end 104 of the first member. Additionally, a storage sleeve 122 may be placed with the second end 115 of the second member 112 for additionally receiving of a cosmetic item 124.

Figure 7B:
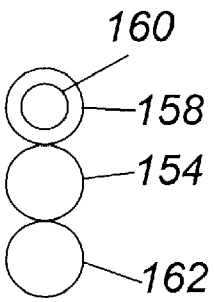
FIG. 7B is an end view of FIG. 7A.
Figure 7A:
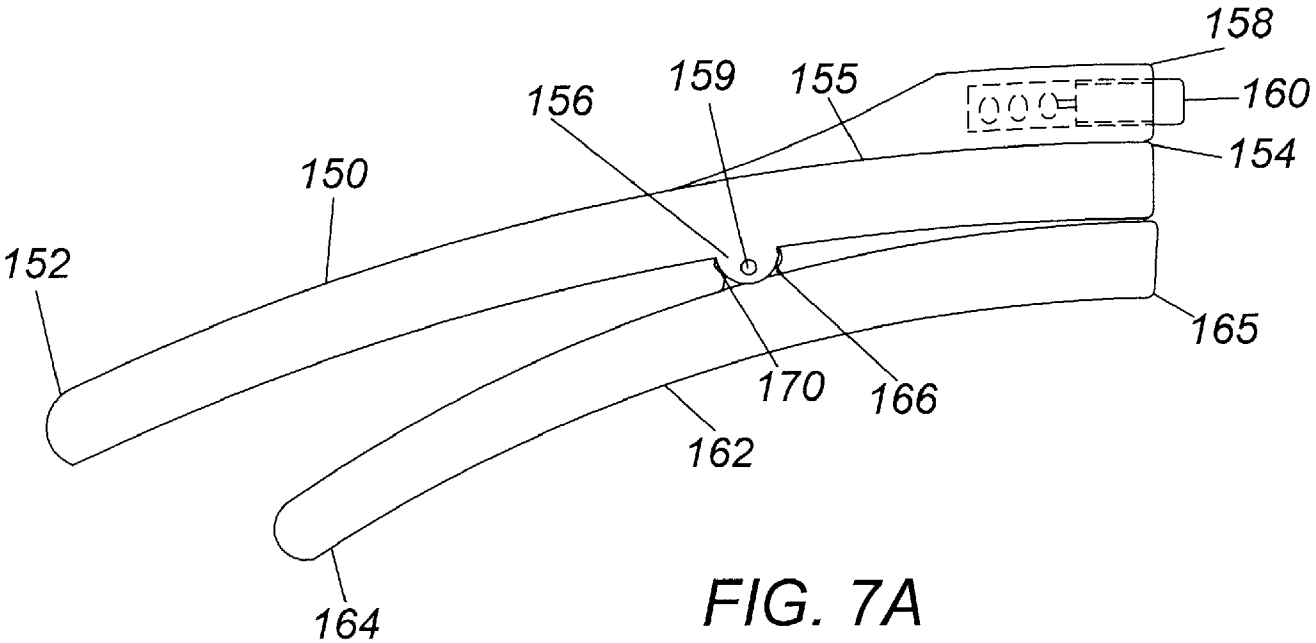
FIG. 7A is a side elevation view depicting a two prong hair clip with a compartment with each member.

Referring now to FIGS. 7A and 7B, set forth is another embodiment of the invention comprising a contoured first member 150 having a first end 152 spaced apart from a second end 154 by a middle portion 156. The second end 154 includes a storage sleeve 158 removably attached to the end by Velcro 155 receipt of a cosmetic item 160. A contoured second member 162 has a first end 164 spaced apart from a second end 165 by a middle portion 166. The middle portion 166 of the second member 162 is pivotally attached to the middle portion 156 of the first member 150 by a pin axle 159. It should be noted that the hair clip is shown in its compressed condition with the first ends 152 and 164 in an open position.

A spring 170 is attached to the pin axle 159 and the middle portions 156 and 166 in a similar manner to the above mentioned springs for urging the first end 152 of said first member 150 and the first end 164 of the second member 162 into a hair-securing orientation. Additionally, a storage sleeve may be placed with the end 154 and/or end 165 for additionally receiving of cosmetic items.

The storage sleeve 158 is releasably mounted to the first member 150 by hook-and-loop fastener material 155 disposed on an exterior of the first member 150 and a corresponding second portion of hook-and-loop fastener material disposed on the storage sleeve 158.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. An improved hair clip comprising:

a contoured first member having a first end spaced apart from a second end by a middle portion, said second end being characterized by a plurality of fingers, said middle portion characterized by an articulation sleeve member positioned on an upper side surface, said articulation sleeve member having an open first end and a closed second end and a removable cap adapted to sealingly engage said articulation sleeve member first end;

a contoured second member having a first end spaced apart from a second end by a middle portion, said second end being characterized by a plurality of fingers, said middle portion of said second member being pivotally attached to said articulation sleeve member;

a depending cover contoured member having a first end hingedly secured to a lower side surface of said first member and a second end releaseably secured to said first member forming an inner surface and an outer surface, said inner surfacing including a reflective mirror;

and a biasing means;

whereby said articulation sleeve member is available for storage of a cosmetic and said biasing means urges said fingers of first and second members cooperatively into a hair-securing orientation.

2. The improved hair clip according to claim 1, including a storage sleeve attached to said lower side surface of said first member.

3. The improved hair clip according to claim 2, wherein said storage sleeve is permanently attached to said first member and further includes a storage tube adapted to slidably engage said at least one storage sleeve.

4. The improved hair clip according to claim 1, including a first portion of hook-and-loop fastener material disposed on an exterior of a storage tube and a corresponding second portion of hook-and-loop fastener material disposed on said first member middle portion, said first portion being adapted to releasably engage said second portion.

5. The improved hair clip according to claim 1, including a magnet disposed on an exterior of a storage tube and a magnet-attractive member disposed on said first member middle portion, said magnet-attractive member being adapted to selectively engage said magnet.

6. The improved hair clip according to claim 1, including at least one linking post extending from an exterior of a storage tube and at least one post aperture disposed within said first member, said at least one post being adapted to releasably engage said at least one post aperture.

7. The improved hair clip according to claim 1, including at least one resiliently-deformable attachment clip disposed on an exterior of said first member.

8. The improved hair clip according to claim 1 wherein said reflective mirror is concave.

9. The improved hair clip according to claim 1 further including a hinged cosmetic storage case removably attached to said first member.

10. An improved hair clip comprising:

a contoured first member having a first end spaced apart from a second end by a middle portion, said second end being characterized by a plurality of fingers, said middle portion characterized by an articulation sleeve member positioned on an upper side surface, said articulation sleeve member having an open first end and a closed second end and a removable cap adapted to sealingly engage said articulation sleeve member first end;

a contoured second member having a first end spaced apart from a second end by a middle portion, said second end being characterized by a plurality of fingers, said middle portion of said second member being pivotally attached to said articulation sleeve member; a biasing means;

a depending cover contoured member having a first end hingedly secured to a lower side surface of said first member and a second end releaseably secured to said first member forming an inner surface and an outer surface, said inner surfacing including a reflective mirror;

and at least one storage sleeve attached to said lower side surface of said first member;

whereby said articulation sleeve member is available for storage of a cosmetic and said biasing means urges said fingers of first and second members cooperatively into a hair-securing orientation.

11. The improved hair clip according to claim 10, wherein said storage sleeve is permanently attached to said lower side surface of said first member and further includes a storage tube adapted to slidably engage said at least one storage sleeve.

12. The improved hair clip according to claim 11, including a first portion of hook-and-loop fastener material disposed on an exterior of said storage tube and a corresponding second portion of hook-and-loop fastener material disposed on said first member middle portion, said first portion being adapted to releasably engage said second portion.

13. The improved hair clip according to claim 11, including a magnet disposed on an exterior of said storage tube and a magnet-attractive member disposed on said first member middle portion, said magnet-attractive member being adapted to selectively engage said magnet.

14. The improved hair clip according to claim 11, including at least one linking post extending from an exterior of said storage tube and at least one post aperture disposed within said first member, said at least one post being adapted to releasably engage said at least one post aperture.

15. The improved hair clip according to claim 10, including at least one resiliently-deformable attachment clip disposed on an exterior of said first member.

16. The improved hair clip according to claim 10 wherein said reflective mirror is concave.

17. The improved hair clip according to claim 10 further including a hinged cosmetic storage case removably attached to said first member.

* * * * *